United States Patent [19]

Buck et al.

[11] 4,296,926

[45] Oct. 27, 1981

[54] RED LIGHT - GREEN LIGHT GAME

[75] Inventors: Gordon H. Buck, Torrance; Martha K. Hardwick, Redondo Beach, both of Calif.

[73] Assignee: Mattel, Inc., Hawthorne, Calif.

[21] Appl. No.: 106,715

[22] Filed: Dec. 26, 1979

[51] Int. Cl.[3] ..... A63F 9/14

[52] U.S. Cl. ..... 273/86 R; 273/1 GC

[58] Field of Search ..... 273/1 E, 86 R, 86 B, 273/86 F, 86 G, 86 H, 85 G, 237, 1 GC

[56] References Cited

U.S. PATENT DOCUMENTS

| | | | |
|---|---|---|---|
| 3,367,663 | 2/1968 | Marks | 273/237 |
| 3,423,091 | 1/1969 | Miller | 273/86 F |
| 3,583,538 | 6/1971 | Hurley | 273/85 G |
| 3,604,707 | 9/1971 | Hurley | 273/85 G |
| 3,653,026 | 3/1972 | Hurley | 273/138 A X |
| 3,827,693 | 8/1974 | Barlow et al. | 273/86 F |
| 3,834,702 | 9/1974 | Bliss | 273/86 B |
| 3,888,491 | 6/1975 | Bernard et al. | 273/237 |
| 4,017,072 | 4/1977 | Kurtz | 273/1 GC |
| 4,093,223 | 6/1978 | Wilke et al. | 273/94 R |
| 4,124,211 | 11/1978 | Worrall | 273/237 |
| 4,162,792 | 7/1979 | Chang et al. | 273/86 F |
| 4,216,965 | 8/1980 | Morrison et al. | 273/237 |

OTHER PUBLICATIONS

"Have Fun With Electronic Dice" by R. M. Stitt, Popular Electronics, Jul. 1975, pp. 48–49.

Complete Book of Games and Stunts, by D. A. Hindman, Bonanza Books, 1956, pp. 179, 180.

"Multiplayer LED Racing Game" by W. J. Prudhomme, Popular Electronics, Mar. 1977, pp. 77–79, 84, 85.

*Primary Examiner*—Anton O. Oechsle

*Attorney, Agent, or Firm*—Ronald M. Goldman; Max E. Shirk; David J. Aston

[57] ABSTRACT

A hand-held electronic game of skill. First and second columns of LED's display the positions and movements of the piece indicia of respective first and second players between respective starting and finishing positions. During the first state of a stop/go indicator, the manipulation of either of two player input switches causes the piece indicium displayed on the respective column to advance toward its finishing position. During the second state of the stop/go indicator, the manipulation of either of the two player input switches causes the piece indicium displayed on the respective column to be returned to its starting position. The first and second states of the stop/go indicator are established alternately, and continue for periods the durations of which vary randomly between predetermined minimum and maximum values.

15 Claims, 3 Drawing Figures

RED LIGHT - GREEN LIGHT GAME

BACKGROUND OF THE INVENTION

The present invention relates to hand-held electronic games and more particularly to multi-player hand-held games of skill for children.

With the advent of low cost, miniaturized electronic devices, including LED's, it became practical for the first time to design low cost, battery-operated hand-held electronic games. One example of a hand-held electronic sports game is described in U.S. Pat. No. 4,162,792, entitled "Obstacle Game", which issued in the names of R. S. Chang et al on July 31, 1979. The latter patent describes a football-like game that is manufactured and sold by Mattel, Inc., which game is played on a 27 LED playing field arranged in 3 columns of 9 rows each, the players and player movements being represented by the turn-on and turn-off of adjacent LED's. Also present in this game is the ability to generate sounds, one such sound being a short musical tune that is played upon the occurrence of a touchdown. Other hand-held sports games manufactured and sold by Mattel, Inc. include basketball, soccer, and baseball.

Not among the above-described games are games that have special appeal to young children, i.e., games based on simple themes that are already familiar to children. One such game known as "Statutes" or "Red Light", is described on pages 179–180 of a book entitled "Complete Book of Games and Stunts", by Darwin A. Hindman, published in 1956. As is the case with many children's games, the latter games are not easily realizable in a hand-held format.

The reason is that hand-held games are limited by size, cost and power consumption considerations to the use of relatively small and energy efficient interface devices such as LED's and manual switches. As a result, a designer cannot merely simulate game play that calls for physical movements, turns, closed eyes, etc. The challenge of adapting a game to a hand-held format is further increased by the need to provide the same or greater play value than the original game. Since play value, in turn, is dependent upon the degree to which the game calls for the exercise of strategy and manual skill, as well as luck, such adaptation may not be either straightforward or easy.

SUMMARY OF THE INVENTION

In accordance with the invention, there is provided a new and exciting hand-held electronic game which is similar to a familiar children's game known as "Red Light", and which has easily mastered but challenging rules of play. The new game represents an improvement over its antecedent game in that it requires the exercises of strategy and manual skill, as well as luck and provides enhanced play value and excitement resulting from features not present in the antecedent game.

The electronic game comprising the present invention includes first and second arrays of illuminatable display elements, preferably columns of LED's, for displaying the positions of the players' piece indicia between respective starting and finishing positions as well as a stop/go indicator having a first state during which players' piece indicia may be advanced and having a second state during which any attempt to advance a piece indicium results in a partial or total loss of position. Also included are first and second manual inputs which are used by the players to advance their respective piece indicia up their respective columns, one step at a time. The game also includes an on-off switch and a reset switch which allows a game to be restarted at the beginning of play. Control circuitry, preferably comprising a suitably programmed microcomputer, is included for randomly varying, within predetermined limits, the length of time that the stop/go indicator spends in each of its two states, for moving the players' piece indicia up their respective columns when the manual inputs are operated during the first or "go" state of the stop/go indicator, and for moving the players' piece indicia down their respective columns when the manual inputs are operated during the second or "stop" state of the stop/go indicator.

The present game optionally contemplates a game play feature whereby the number of input switch manipulations necessary to advance the piece indicia up the display columns increases as those piece indicia approach their final, winning positions. The latter game play feature may be used in conjunction with a further optional feature whereby the durations of the states of the stop/go indicator may be changed to change the skill level of the game.

DETAILED DESCRIPTION OF THE PREFERRED EMBODIMENT

Figure 1:
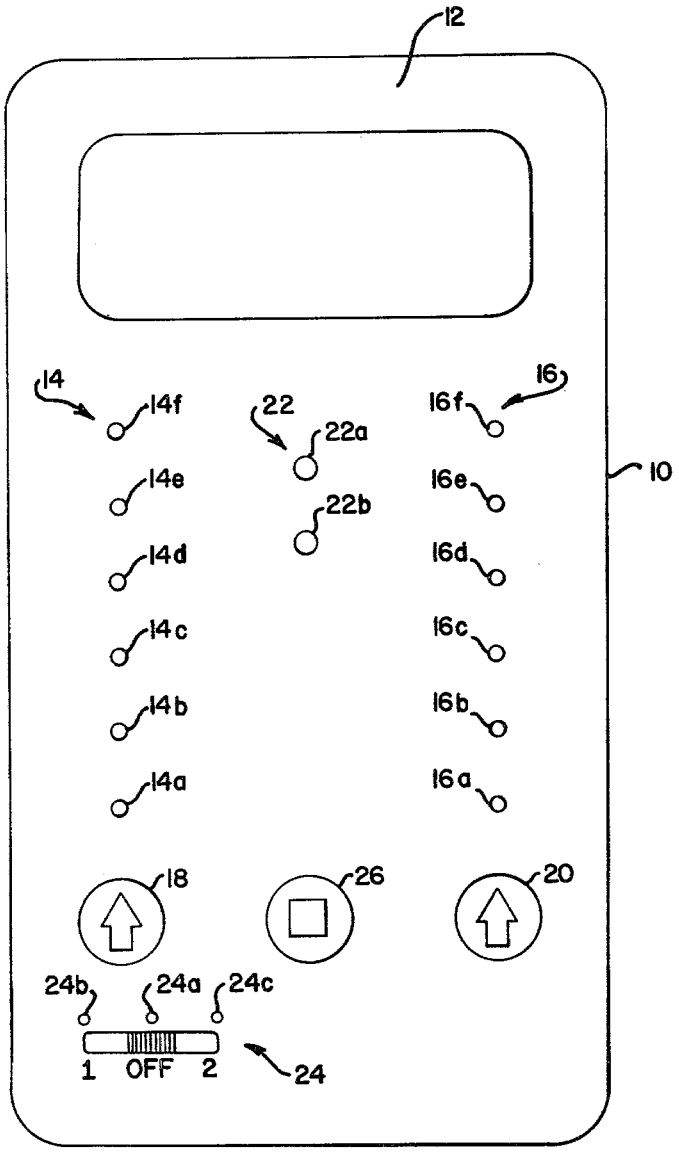
FIG. 1 shows a plan view of the external appearance of one embodiment of the game.

The embodiment of FIG. 1 includes a housing 10, preferably of plastic, which may be provided with the handle 12 whereby the game may be conveniently carried. Although not illustrated to scale, the housing is preferably 6.7 inches long, 3.5 inches wide and 1.0 inch deep. The embodiment also includes a first array of illuminatable display elements 14 which preferably comprises a column of LED's **14*a* through 14*f*, each of which (when illuminated) is representative of one of the possible positions of a first players' piece indicium between a starting position 14*a* and a finishing or winning position 14*f*. Similarly, the game includes a second array of illuminatable display elements 16, also LED's, for displaying the position of a second players' piece indicium between a starting position 16*a* and a finishing or winning position 16*f*. It will be understood that the number of display elements in columns 14 and 16** may be greater or less than six, but that six has been chosen as a reasonable compromise value which affords real play value and low manufacturing cost.

Also shown in FIG. 1 are respective first and second manual input means 18 and 20, respectively, which may take the form of momentary contact switches, and stop/go indicating means 22 which preferably includes a red or "stop" LED **22*a* and a green or "go" LED 22*b*. Stop/go indicator 22 indicates to the players when they may safely attempt to advance their piece indicia. A reset or restart switch 26 is included, which allows a game to be restarted at the beginning of play, and a slide switch 24 whereby the game may be turned on and off. Housing 10 contains the control circuitry (not visible in FIG. 1) shown in FIG. 3**, a printed circuit board for mounting the control circuitry and LED's, and a power source such as a battery.

When indicating means 22 is in its first state, i.e., when green LED 22*b* is on and red LED 22*a* is off, the depression of either or both manual inputs will cause the respective players' piece indicia (the illuminated ones of the LED's) to advance one step between their respective starting and finishing positions "a" and "f". Additional depressions of either or both manual inputs, during the same or subsequent periods of illumination of LED 22*b*, will cause the players' piece indicia to advance additional steps between their respective starting and finishing positions.

When stop/go indicating means 22 is in its second, alternate state, i.e., when red LED 22*a* is on and green LED 22*b* is off, the depression of either or both manual input switches will cause the respective piece indicia to be moved back toward their respective starting positions. In the preferred embodiment of the present invention, the manipulation of either manual input switch during the second state of indicator 22 causes the associated piece indicium to be returned all the way back to its starting position, a condition which enhances play value by discouraging inattentive play. Optionally, however, the penalty for depressing a player input switch during the second or red state of indicator 22 may be less than a total loss of position. The player's piece indicium might, for example, be moved back only one step for each incorrect input switch depression.

In accordance with one feature of the present invention, the durations of the alternate periods of illumination of stop/go indicator LED's 22*a* and 22*b* are arranged to vary in a random (strictly speaking pseudorandom) manner between selectable predetermined limits. Red LED 22*a* will, for example, turn on for a variable time that may be as short as approximately 0.35 second or as long as approximately 2.8 seconds, following which green LED 22*b* will become illuminated for a variable time that may be as short as 0.35 second or as long as 2.8 seconds. The actual duration of each period of illumination within these maximum and minimum values is determined by a random time control circuit (or alternatively a random number generating subroutine) as will be explained more fully hereinafter.

In the event that a more challenging game is desired, the above-described minimum and maximum values may be shortened so that at a second, higher skill level, the durations of the alternate periods of illumination of red and green LED's 22*a* and 22*b* will vary randomly between lower minimum and maximum values such as approximately 0.2 and 0.85 seconds. In addition, at a third skill level, the durations of the alternate periods of illumination of red and green LED's 22*a* and 22*b* may vary randomly between even lower minimum and maximum values. The manner in which these higher skill levels are selected will be described more fully presently.

Another way in which to make the game more challenging is to make the number of player switch depressions necessary to advance a player's piece indicium one step up its respective display column variable in one or both of two ways. The first of these ways is to make the number of switch depressions necessary to advance one display step a function of a player's position in his column. The advance to display steps "e" and "f", for example, may be made to require twice as many switch depressions as the advance to display steps "b", "c" and "d". It will be understood that a player's advance may also be imparted a non-linear difficulty characteristic by requiring that his switch be depressed for a minimum time which increases as his piece indicium approaches its finishing position.

Another of the ways in which the game may be made more challenging is to uniformly increase the number of switch depressions necessary to produce an advance. At a first skill level, for example, the advance to steps "b", "c" and "d" may each require one correct switch depression while the advance to steps "e" and "f" each require two correct switch depressions. At a second skill level, on the other hand, the advance to steps "b", "c" and "d" may each require two switch depressions while the advance to steps "e" and "f" each require four switch depressions.

While the above-described techniques for changing the skill level of the game may be made independently, by means of separate switches, the preferred embodiment of the game allows these changes to be made through the use of the switches that are already present, such as player switches 18 and 20, on-off switch 24 and restart switch 26. This not only reduces the number of switches (and thereby the cost of the game), but does so in a way that maximizes the overall number of skill levels provided by the game. In general, as will be seen from the following summary of the various skill levels that may be selected by a player, the player switches 18 and 20 control the time limits on the states of indicator 22 and on-off switch 24 controls the number of switch depressions necessary to advance one step.

(a) Skill level 1: on this skill level the states of indicator 22 have their longest durations and the number of switch depressions per step has its lowest value; this skill level is selected when on-off switch 24 is moved from off position 24*a* to on position 24*b*.

(b) Skill level 2: on this skill level the states of indicator 22 have their longest durations and the number of switch depressions per step has its highest value; this skill level is selected when on-off switch 24 is moved from off position 24*a* to on position 24*c*.

(c) Skill level 3: on this skill level the states of indicator 22 have intermediate durations and the number of switch depressions per step has its lowest value; this skill level is selected when player switch 18 is held down as on-off switch 24 is moved to position 24*b*; alternatively, with switch 24 in position 24*b*, player switch 18 is held down during the depression of restart switch 26.

(d) Skill level 4: on this skill level the states of indicator 22 have intermediate durations and the number of switch depressions has its highest value; this skill level is selected when player switch 18 is held down as switch 24 is moved to position 24*c*; alternatively, with switch 24 in position 24*c*, player switch 18 is held down during the depression of restart switch 26.

(e) Skill level 5: on this skill level the states of indicator 22 have their shortest durations and the number of switch depressions has its lowest value; this skill level is selected in the same manner as level 3 except that player switch 20 rather than 18 is held down.

(f) Skill level 6: on this skill level the states of indicator 22 have their shortest durations and the number of switch depressions has its highest value; this skill level is selected in the same manner as level 4 except that player switch 20 rather than 18 is held down.

In view of the foregoing, it will be seen that the preferred embodiment of the invention not only provides two independent types of controls over the skill level of the game, but provides these controls without increasing the number of game switches above that which would be present in any event. While this feature is not regarded as the most significant novel feature of the present invention, it is nevertheless considered to be an important novel feature.

Because changes between the first and second states of indicator 22 occur substantially instantaneously, and because the duration of each state varies in a random manner, a player must adopt a strategy by which the speed with which he advances is weighed against the risk of being returned to his starting position as a result of an incorrect switch depression. In addition, because of the limited time within which a player must respond with a known number of switch depressions, each player's success also depends both upon the speed and the coordination of his physical responses. As a result, it will be seen that, in spite of its apparent simplicity, the game is a challenging one which demands strategy, speed and coordination as well as luck.

In addition to the above-described features relating to the play value of the game, other features may be provided to increase its entertainment value. In the preferred embodiment, for example, the turn-on or restart of the game results in the playing of a short musical presentation. In addition, during the course of game play, successfully advancing one step up the display column is accompanied by a success sound such as a "beep", while a loss of position is accompanied by a failure sound such as a "raspberry" sound. Finally, at the end of the game, there is produced a victory presentation which consists of the sequential flashing of the LED's in the winner's display column, the extinguishing of the LED's in the loser's display column and the playing of a victory tune. At the end of this presentation the LED in the finishing position of the winner remains illuminated while the loser's LED's remain extinguished, a condition which continues until game play is re-initiated by the depression of reset switch 26 or the operation of on-off switch 24.

Figure 2:
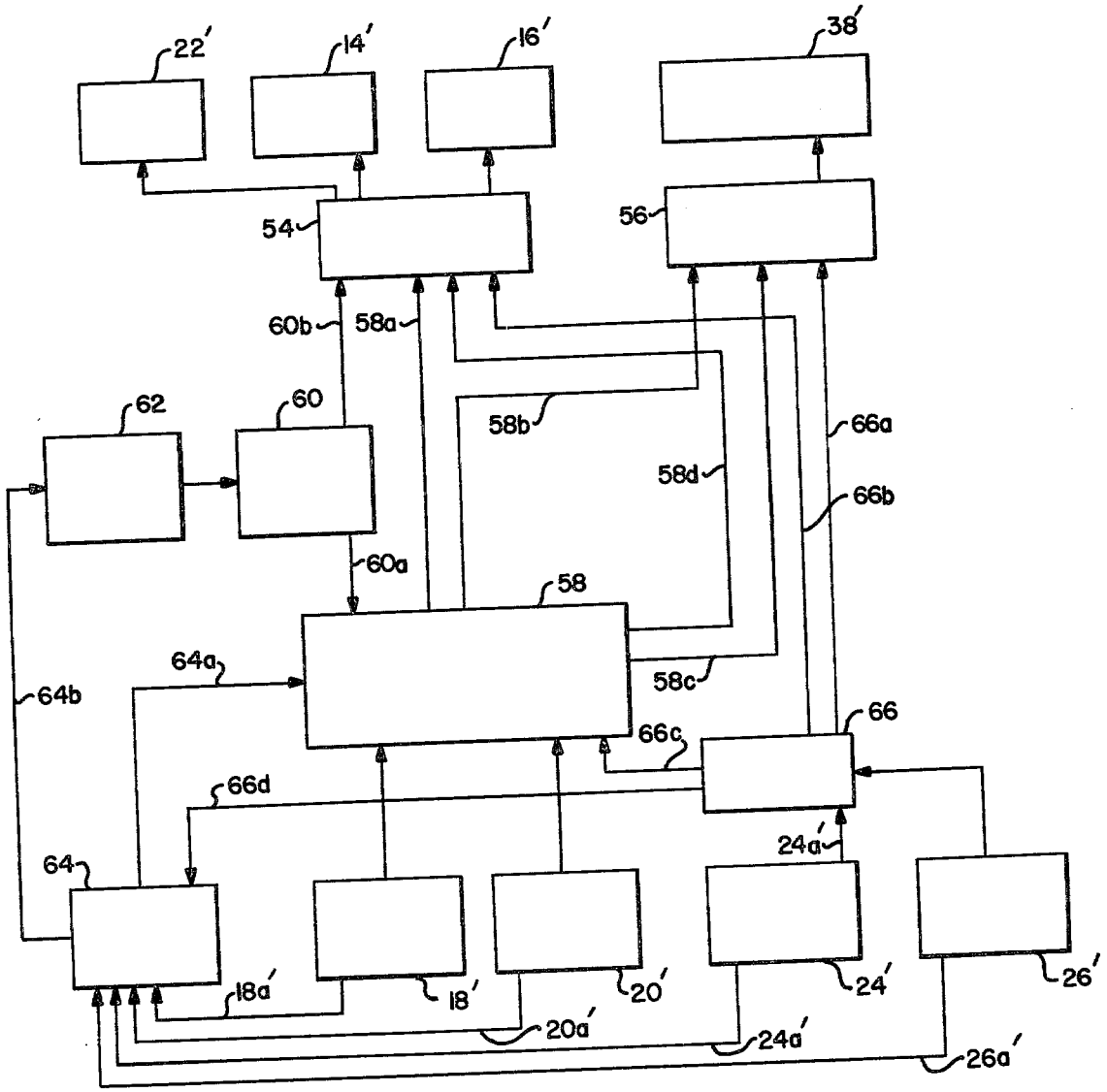
FIG. 2 is a block diagram of one illustrative embodiment of the invention.

Referring to FIG. 2, there is shown a block diagram of one illustrative embodiment of the invention. In FIG. 2 each block represents a device or set of devices that performs one of the major game play functions such as initialization. In addition, each connecting line represents a control relationship between the connected blocks, the direction of the arrows indicating the direction in which control is exerted. It will be understood that if the game is constructed with a programmed microcomputer, rather than with hardwired logic, certain of the blocks of FIG. 2 will represent an instruction or set of instructions, rather than a physical device or set of devices. The remaining blocks, i.e., those that represent I/O or interface functions such as a manual input switch represent physical devices in both hardwired and microcomputer-based embodiments of the invention.

The input blocks by which the game of FIG. 2 is controlled by the players include player #1 switch block 18', player #2 switch block 20', on/off switch block 24' and reset switch block 26'. Similarly, the output blocks by which the game of FIG. 2 presents game status information to the players include stop/go indicator display block 22', column #1 display block 14', column #2 display block 16' and speaker block 38'. In each case the prime notation indicates that a corresponding device with the same number appears in FIG. 1 or FIG. 3.

Associated with displays 14', 16' and 22' is a display control block 54 which causes the displays to show the game status and the positions of the players' piece indicia, or the end-game light presentation, depending upon the control information supplied thereto by the remaining blocks of FIG. 2. Similarly, associated with speaker 38' is a sound control block 56 which causes the speaker to generate the various game play sounds, or the beginning-game and end-game sound presentations, depending upon the control information supplied thereto by the remaining blocks of FIG. 2.

Also included in FIG. 2 is a player position control block 58, a stop/go indicator control block 60, a random time control block 62, a skill level control block 64, and an initialization control block 66. When the game is turned on by operating on/off switch 24', initialization control block 66 is activated through line **24*a'* to cause display control block 54 and sound control block 56 to produce the desired beginning-game light and sound presentations on displays 14', 16' and 22' and speaker 38'. This occurs as a result of control information supplied to blocks 54 and 56 through lines 66*a* and 66*b*. At the same time, initialization control 66, acting through line 66*c*, causes the desired initial positions of the player piece indicia to be established in player position control block 58 which, in turn, causes those initial positions to be displayed on displays 14' and 16' at the beginning of regular game play. Initialization control 66 also activates skill level control block 64, through line 66*d*, to cause the latter to determine the desired skill level from the status of switches 18', 20', 24° and 26', through lines 18*a'*, 20*a'*, 24*a'* and 26*a'*, respectively. Once the desired skill level has been determined, the skill level of the game is established as skill level control 64 supplies to player position control 58, through line 64*a*, the number of player switch manipulations necessary to advance a piece indicium one step up its column. At the same time, skill level control 64 supplies to random time control 62, through line 64*b*, the minimum and maximum times to be used in controlling stop/go indicator 60. The latter, in turn, communicates the stop/go indicator status to player position control 58, through line 60*a*, and, at the same time, supplies this information to display control 54, through line 60*b*, to establish the desired indication on stop/go indicator display 22'**.

After initialization, and based upon the skill level established by skill level control 64, player position control 58 utilizes the information communicated thereto by stop/go indicator control 60 and player switches 18' and 20' to determine the position of the piece indicia of both players. This position information is then supplied to display control 54, through line **58*a*, to produce the desired indication on display columns 14' and 16'. Concurrently, player position control 58 provides to sound control block 56, through line 58*b*, the control information that produces the game play sounds which, as previously described, occur upon the manipulation of player switches 18' and 20'**.

Upon successfully advancing a piece indicium from its starting to its finishing position, player position control 58 determines that the game has been won. Player position control 58 then identifies the winning player and initiates the end-game or victory light and sound presentations by providing the appropriate control information to sound control block 56, through line **58*c*, and to display control 54, through line 58*d*. At the conclusion of these presentations, the winning player's piece indicium remains illuminated until the next game is started as, for example, by operating reset switch 26'**.

As those skilled in the art recognize, the circuitry used to implement the above-described game may be constructed from a variety of different types of available electronic devices marketed by numerous different semiconductor manufacturers. Among those types of known devices are: general purpose electronic building blocks, such as discrete transistors, AND gates and shift registers; special purpose electronic building blocks, such as custom large scale integrated (custom LSI) circuits that incorporate, on a single chip, in a fixed relationship, large numbers of the just mentioned general purpose electronic building blocks; and general/special purpose electronic building blocks, such as microcomputers which are general purpose LSI devices that may be converted to special purpose devices by the mask programming of a read only memory chip or of the ROM portion of the microcomputer chip itself. The choice as to which of these devices and approaches will be used in a particular design is often related to the number of units to be manufactured. While any of the above-described devices and approaches may be used in physically implementing the present game, the preferred embodiment uses a small microcomputer that is mask programmable by the manufacturer in which the program is fixed in tangible form in the ROM portion of the chip in order to take advantage of the small size, low power consumption and low cost of that form of implementation, which is believed to best benefit the game user.

Figure 3:
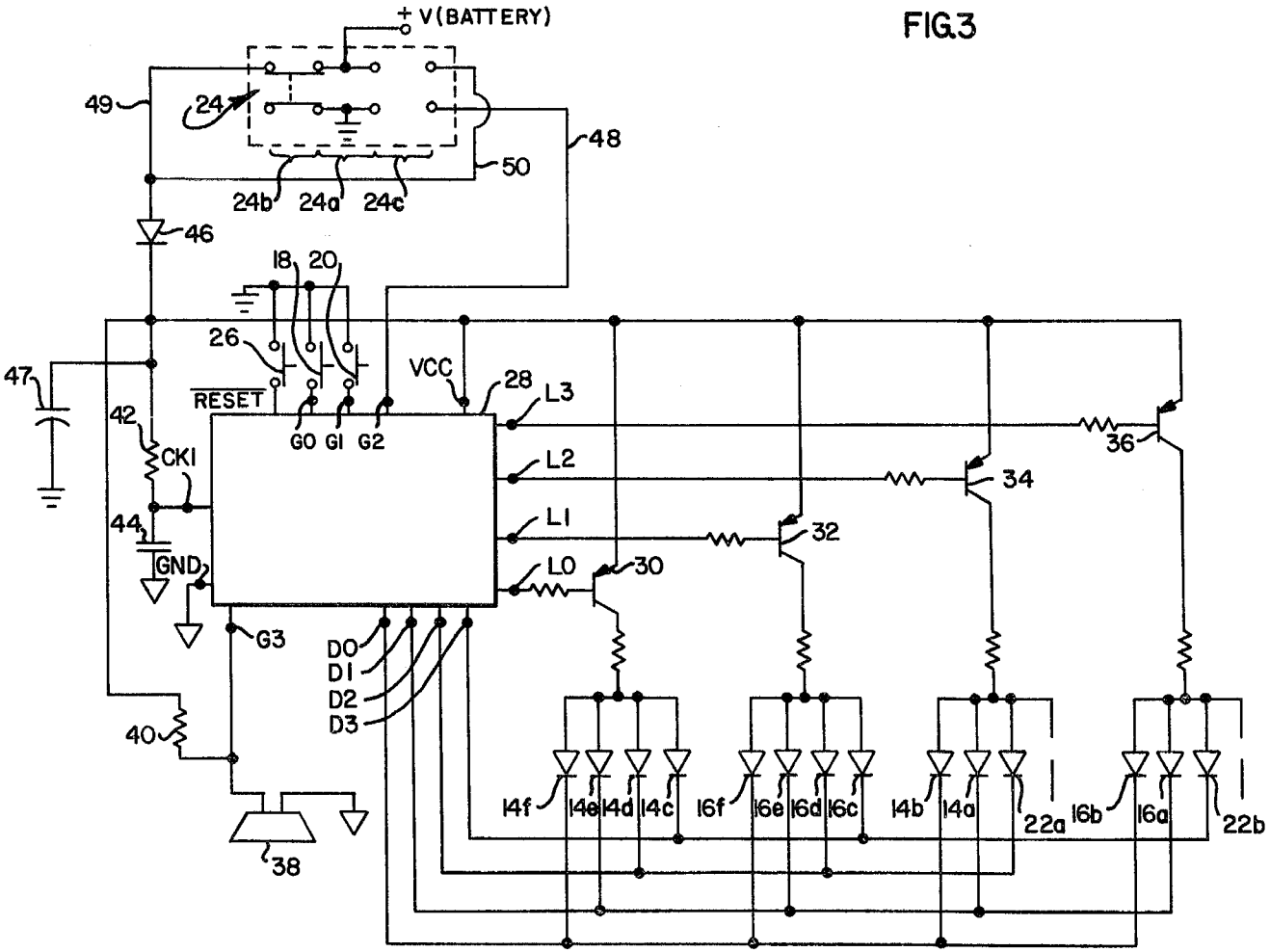
FIG. 3 is a schematic diagram of the internal structure of the preferred embodiment of the present invention.

As shown in FIG. 3, the preferred embodiment of the invention includes a commercially available, National Semiconductor microcomputer chip sold under the designation COP 410L. The latter chip is one of a series of chips in the COPS family, COP being an acronym for Control Oriented Processor. The COPS family, including the COP 410L, is described in National Semiconductor manual number 420305 785-001, entitled "COPS Chip User's Manual". Generally speaking, the subject chip includes a four bit arithmetic logic unit (ALU), a four bit accumulator, a random access memory (RAM) capable of storing 32 words of four bits each, a program memory comprising a read only memory (ROM) having a capacity of 512 words of 8 bits each, a 9 bit program counter, with which is associated a 9 bit, 2 level stack, and an on-chip clock. These structures work together to read the input status and data appearing at the chip's I/O ports, process that information in accordance with the program stored in the program memory and output the result through the chip's I/O ports. Thus, the COP 410L chip is typical of many currently available microcomputer chips.

As shown in FIG. 3, the above-described microcomputer chip is provided with power supply leads Vcc and GND, clock control lead CKI, a reset lead $\overline{\text{RESET}}$ through which the program counter may be reset, a four bit output port comprising leads D0 through D3, a four bit I/O port comprising leads G0 through G3, and an eight bit I/O port comprising leads L0 through L7, that is capable of directly driving eight LED's. Other leads are also present, but are not used in implementing the present invention.

Referring to FIG. 3, there is shown a schematic diagram of the circuitry of the preferred embodiment of the invention, all elements that are shown in more than one Figure being assigned the same number in all Figures. This circuit includes a microcomputer chip 28 which may be of the previously described National Semiconductor type COP 410L. For the convenience of the reader, the leads of the latter chip are labeled with the numbers and letters which are used by the manufacturer and which have been introduced above. The circuit of FIG. 3 also includes a plurality of LED's 14*a* through 22*b* which are connected to leads L0 through L3 of chip 28, in groups of three or more, through respective PNP driver transistors 30 through 36. Also included in the circuit of FIG. 3 is speaker 38 which is connected between the circuit ground and the positive supply through a pull-up resistor 40, and which is also connected to chip output G3. A suitable RC network comprising a resistor 42 and a capacitor 44 is connected to chip input CKI to set the operating frequency of the on-chip clock. Except for a reverse-battery protection diode 46 and a filter capacitor 47, the remaining devices shown in the circuit of FIG. 3 are manual switches, the functions of which have already been described in connection with FIGS. 1 and 2, FIG. 3 merely showing how these devices are physically connected to the inputs of Chip 28 to achieve the previously described results.

The operation of the circuit of FIG. 3 will now be described. When switch 24 is in its center or off position 24*a*, chip 28 is disconnected from the positive supply (+v), which may be a suitable battery, and the circuit is inactive. In both of the off-center positions 24*b* and 24*c* of switch 24, the positive supply is connected to chip lead Vcc, through diode 46, and the circuit assumes its active state to provide the previously described game play.

When switch 24 is in its leftmost position 24*b*, chip lead G2 is disconnected, causing a high-state voltage to appear at chip lead G2. As this condition is sensed during program execution, the flow of the program is altered (as by the setting of flags) in a way which establishes operation in the previously described skill-level 1 mode. When, on the other hand, switch 24 is in its rightmost position 24*c*, ground is applied to chip lead G2 through conductor 48. As this condition is sensed during program execution, the flow of the program is altered in a way which establishes operation in the previously described skill-level 2 mode. Thus, chip 28 reads the voltage state at lead G2 and uses the same to control the skill-level of the game.

Similarly, the voltages at chip leads $\overline{\text{RESET}}$, G0 and G1 are read by Chip 28 to determine whether the flow of the program should be changed to reflect other changes in playing conditions such as the depression of player switch 18 or 20 or reset button 26. Chip lead G3, although conceptually a part of the four bit I/O port including leads G0 through G3, is used as a one bit output to speaker 38. This usage of lead G3 as an output is possible because Chip 28 is programmed so that the stage of lead G3 is not used during the execution of input instructions and so that the states of leads G0 through G2 are not used during the execution of output instructions.

Once the normal playing condition of the game is established, the illumination of LED's 14*a* through 22*b*, and the sounds generated by transducer 38, are determined by the sequence of signal states which Chip 28 produces at leads L0 through L3, D0 through D3, and G3 thereof. All of the latter are, in turn, controlled in accordance with the flow of the game program as determined by the conditions which switches 18, 20 and 26 establish at chip leads $\overline{\text{RESET}}$, G0 and G1, respectively.

In the present embodiment, the LED's are actually illuminated only one at a time, but are illuminated in sequence at a sufficiently high rate that they produce no perceptible flicker to a human observer, i.e., the LED's are driven by the use of multiplexing techniques. In spite of the fact that the LED's are connected to the L0 through L3 outputs of Chip 28 in groups of three or more, each of the LED's can be illuminated independently of the others in the same group. This is possible because the cathodes of the LED's in each such group are connected to different ones of the leads D0 through D3 of Chip 28. LED 14*f*, for example, is illuminated only when a low state voltage at chip output L0 turns on LED driver transistor 30 at the same time that a low state voltage appears at chip lead D0. Similarly, LED's 14*e* through 14*c* are illuminated only when a low state voltage at chip lead L0 coincides with low state voltages at chip leads D1, D2 and D3, respectively.

In producing the previously described game sounds, speaker 38 conducts current through current limiting resistor 40, except when the speaker side of resistor 40 is grounded by a low state voltage at chip lead G3. As a result, when the execution of the program causes chip lead G3 to alternate between its high and low voltage states, an intermittent current will flow through speaker 38. This intermittent current is converted by speaker 28 to audible sounds. The timing information necessary to cause these audible sounds to conform to the desired game sounds is stored in the program of Chip 28 and is used as necessary during the execution of the program. Because the internal layout and operation of the chip used in the preferred embodiment and equivalent computer or processor chips are known to those skilled in the art, the structure and operation thereof will not be further described herein.

The technique employed to generate the above-described random variations in the durations of the states of stop/go indicator 22 will now be described. In this description, it will be understood that the operations described are performed during the execution of a program segment which includes a subroutine. For the sake of brevity and clarity, however, the operations will be described as if they were performed by equivalent discrete devices.

The random time control includes a counter which is preset to a number that is related to the minimum and maximum values of the desired random time periods. The random time control also includes a shift register that responds to the completion of a counting sequence in the counter by shifting a binary "seed" number and storing the bit that overflows the register as, for example, by setting a flag. Finally, the random time control includes an exclusive-or gate which enters into the least significant bit of the shift register the result of the exclusive-oring of the two most significant bits of the shift register. As will be described presently, it is this exclusive-oring which is responsible for the desired randomness.

Upon each pass through the main program of the game, the counter is decremented by one and tested. If the counter has not counted to zero, the main program simply continues. If the counter has counted to zero, the "seed" number in the shift register is shifted one place to the left, causing a new "1" or "0" to be stored as an overflow bit, a "1" overflow bit causing the illumination of red indicator 22*a* and a "0" overflow bit causing the illumination of green indicator 22*b*. Since the time for which a "1" or "0" overflow bit is stored and, therefore, the time which indicator 22 spends in one of its states cannot be predicted by the players, it is for all practical purposes random. Since, the addition, the state of the overflow bit cannot change in less time than it takes for the counter to complete a counting sequence, there is a minimum value for the duration of either state of stop/go indicator 22. Finally, since the shift register and exclusive-or gate will not allow the state of the overflow bit to remain unchanged for a time greater than a time equal to the number of shift register stages multiplied by the time required for the counter to complete a counting sequence, there is a maximum value for the duration of either state of the stop/go indicator 22.

In view of the foregoing, it will be seen tht both the minimum and maximum time that indicator 22 spends in either of its states depends upon the time required for the counter to complete a counting sequence. As a result, both limits may be fixed by the choice of the number with which the counter is preset. In the present game this fact is utilized by selecting in advance the numerical values which produce the desired maximum and minimum time limits, storing these values and presetting them into the counter in accordance with the skill level selection of the players.

One result of the use of the just described technique for fixing the minimum and maximum values of the durations of the states of indicator 22 is that those durations which are between the minimum and maximum values are not random in the strict, mathematical sense. This is because these durations can have only a discrete number of values, the discrete number resulting from the fact that each duration must be an integral multiple of the duration of the above-mentioned counting sequence. Since, however, the number of possible durations for the states of indicator 22 is large, and since these durations cannot be predicted by the players, those durations are sufficiently random (or pseudo-random) to allow the game to operate in the desired manner.

Given the above-described circuit elements and their relationships to one another, and given the above-described rules of play, those skilled in the art will be able, without undue experimentation, to write the kinds of programs which can be used in implementing the preferred embodiment. It is, therefore, believed unnecessary to include or describe in detail any particular program listing in this specification. For the sake of convenience, however, those wishing to do so may make reference to the exemplary copyrighted program listing (owned by Mattel, Inc.) which accompanies this application and which is expressly incorporated herein by reference. In view of the foregoing detailed description of the desired game play and in view of the prevailing level of skill in assembly language programming, the accompanying illustrative program listing will not be specifically described herein.

Although the invention has been described above in detail with reference to a particular microcomputer chip and particular program, it should be appreciated that the scope of the present invention should be determined solely with reference to the following claims.

What is claimed is:

1. An electronic game comprising:

a first array of discrete, illuminatable display elements for displaying the position of a first player's piece indicium, a second array of discrete, illuminatable display elements for displaying the position of a second player's piece indicium, a stop/go indicator having first and second states, a first manual input, comprising a first momentary contact switch, inputting to a position control means, a second manual input, comprising a momentary contact switch, inputting to said position control means, stop and go control means, outputting to said stop/go indicator alternately establishing the first and second states of said indicator, for controlling said position control means, said position control means being for moving the first player's piece indicium in one direction by sequentially turning on one display element and turning off another in response to each contact of said first momentary contact switch in said first array when the first manual input is operated during the first state of said indicator and in the opposite direction in said first array when the first manual input is operated during the second state of said indicator and moving the second player's piece indicium in one direction by sequentially turning on one display element and turning off another in response to each contact of said second momentary contact switch in said second array when the second manual input is operated during the first state of said indicator and in the opposite direction in said second array when the second manual input is operated during the second state of said indicator.

2. An electronic game as set forth in claim 1 further comprising random time control means, independent of said position control means, outputting to said stop and go control means, for varying in a random manner, the time that said indicator spends in said first and second states.

3. An electronic game as set forth in claim 2 in which the random time control means for controlling the randomly variable time that said indicator spends in said first and second states is restricted by predetermined minimum and maximum values.

4. An electronic game as set forth in claim 3 including a skill level control outputting to said random time control means for changing said predetermined minimum and maximum values and thereby changing the skill level of the game.

5. An electronic game as set forth in claim 1 in which a predetermined number of momentary contact switch manipulations greater than one is necessary to turn-off one LED and turn-on an adjacent LED.

6. An electronic game as set forth in claim 5 further comprising random time control means, outputting to said stop and go control means, for randomly varying, between predetermined maximum and minimum values, the time that said indicator spends in said first and second states.

7. An electronic game as set forth in claim 5 including a skill level control, outputting to said position control means, for changing said predetermined number and thereby changing skill level of the game.

8. An electronic game as set forth in claim 6 including a skill level control outputting to said random time control means for changing said predetermined minimum and maximum values and thereby changing the skill level of the game.

9. An electronic game comprising:

a first column of illuminatable display elements for displaying the position and movements of a first player's piece indicium from a starting position to a finishing position, a second column of illuminatable display elements for displaying the position and movements of a second player's piece indicium from a starting position to a finishing position, a stop/go indicator having first and second visually perceptable states, a first player input, comprising a momentary contact switch for initiating attempted movements of a second player's piece indicium toward its respective finishing position, a second player input, comprising a momentary contact switch, for initiating attempted movement of a second player's piece indicium towards its respective finishing position, a stop and go circuit for alternately establishing the first and second states of said indicator; and a position control circuit, responsive to said stop and go circuit and said first player input and said second player input, for moving a player's piece indicium, by sequentially turning on one display element and turning off another in response to each contact of a contact switch, toward its respective finishing position when the respective player input is operated during the first state of the indicator, and for moving a player's piece indicium by sequentially turning on one display element and turning off another in response to each contact of a contact switch away from its respective finishing position when the respective player input is operated during the second state of the indicator.

10. An electronic game as set forth in claim 9 in which the stop and go circuit causes said indicator to alternate between its first and second states, and to remain in each of said states for a randomly variable time that is greater than or equal to a predetermined minimum time and less than or equal to a predetermined maximum time.

11. An electronic game as set forth in claim 10 in which a predetermined number of switch depressions greater than one of said first player input and said second player input is necessary to move a player's piece indicium one LED closer to its finishing position.

12. An electronic game as set forth in claim 11 in which said predetermined number of switch depressions may be changed to change the skill level of the game.

13. An electronic game as set forth in claim 10 in which said predetermined minimum and maximum times may be changed to change the skill level of the game.

14. An electronic game as set forth in claim 9 in which the operation of either player input during the second state of said indicator causes the return of the respective player's piece indicium to its starting position.

15. An electronic hand-held game comprising:

first and second columns of at least six LED's, the LED's of each column comprising a succession of steps between a start position and a finish position, each LED, when illuminated, serving to represent one position of a respective player's piece indicium in the respective column, a stop LED and a go LED, first and second player switches, an on-off/skill select switch having an off position and first and second skill select positions, a speaker for generating audible sounds, control means for (i) alternately illuminating the stop and go LED's, the time during which each LED is illuminated being greater than or equal to a predetermined minimum and less than or equal to a predetermined maximum, (ii) moving the first player's piece indicium at least one step closer to its finish position when the first player switch is manipulated during the time that the go LED is illuminated, and moving the first player's piece indicium back to its start position when the first player switch is manipulated during the time that the stop LED is illuminated, (iii) moving the second player's piece indicium at least one step closer to its finish position when the second player switch is manipulated during the time that the go LED is illuminated, and moving the second player's piece indicium back to its start position when the second player switch is manipulated during the time that the stop LED is illuminated, (iv) changing said predetermined minimum and maximum to change the skill level of the game, (v) causing the advance of either player's piece indicium to require a first predetermined number of manipulations of the respective player switch when said on-off /skill select switch is in its first skill select position and a second predetermined number of manipulations of the respective player switch when said on-off/skill select switch is in its second skill select position, and (vi) applying to said speaker a fluctuating current which produces a success sound when a player's piece indicium moves one step closer to its finish position and a failure sound when a player's piece indicium moves back to its start position; said control means having a plurality of input leads and a plurality of output leads, means for connecting said player switches and said on/off skill select switch to respective input leads of said control means, means for connecting the LED's of said first and second columns, said stop LED and said go LED to the output leads of said control means, means for connecting said speaker to a respective output lead of said control means, wherein the movement of a player's piece indicium in its respective column consists of the turn-off of an illuminated LED and the turn-on of another LED in the same column.

* * * * *